United States Patent [19]

Morrison

[11] Patent Number: 4,809,946

[45] Date of Patent: Mar. 7, 1989

[54] HOT TOP WITH SEALING ANGLE BAR

[75] Inventor: Lynn A. Morrison, Magnolia, Ohio

[73] Assignee: The Whitacre-Greer Fireproofing Company, Waynesburg, Ohio

[21] Appl. No.: 924,767

[22] Filed: Oct. 30, 1986

[51] Int. Cl.[4] ..... B22D 7/10

[52] U.S. Cl. ..... 249/197; 249/106

[58] Field of Search ..... 249/197-202, 249/106, DIG. 5

[56] References Cited

U.S. PATENT DOCUMENTS

| | | | |
|---|---|---|---|
| 1,394,415 | 10/1921 | Howard et al. | 249/201 |
| 2,946,103 | 7/1960 | Vallak | 249/197 |
| 3,680,827 | 8/1972 | Rausch | 249/202 |

FOREIGN PATENT DOCUMENTS

| | | | |
|---|---|---|---|
| 726094 | 1/1966 | Canada | 249/106 |

*Primary Examiner*—Nicholas P. Godici
*Assistant Examiner*—J. Reed Batten, Jr.
*Attorney, Agent, or Firm*—Oldham, Oldham & Weber Co.

[57] ABSTRACT

The hot top utilizes an integral angle iron structure connected to the hot top for avoiding seal leaks of molten metal through the space between the bottom portion of the hot top and the top of the mold wall. By providing the angle iron structure with a plurality of holes which allow the cooling ingot metal to tear out portions of the structure as the ingot contracts, such structure also allows the cooling ingot to move downwardly in the mold and to separate from the structure, thereby preventing hanger cracks from occurring.

3 Claims, 2 Drawing Sheets

HOT TOP WITH SEALING ANGLE BAR

TECHNICAL FIELD

This invention relates to the formation of metal ingots from molten metal, especially to the formation of steel ingots. More particularly, the invention relates to a "hot top" for ingot molds positioned over the top surface of the mold, which serves as a reservoir for molten metal. The reservoir allows molten metal to flow downward therefrom into the central part of the mold as the metal in the mold cools and shrinks, thereby preventing the formation of voids in the solidified metal, a phenomenon known in the art as "piping." Hot tops allow metal contained in them to remain in a molten state over the molds for an appreciable period of time during the solidification process, and thus available to fill any shrinkage cavities formed as the metal cools.

BACKGROUND ART

The instant invention is particularly designed as an improvement over U.S. Pat. No. 3,762,680, conveyed to the same assignee as the instant application. The "Background of the Invention" portion of U.S. Pat. No. 3,762,680 provides a detailed description of the state-of-the-art, from the use of heavy cast iron hot tops, to the more recent practice involving the use of improved "consumable" hot tops.

While consumable hot tops have certain advantages, including the ability to minimize piping, it has been found to be difficult to maintain them in position on top of the mold without having molten metal leak out at the interface between the hot top and the mold, or experiencing "floating", i.e., having the hot top rise from the top of the mold due to buoyancy, of the molten metal. Either of such occurences can result in ruining the ingot being poured. Furthermore, in instances where a sealing mechanism is provided between the consumable hot top and the mold, an additional problem can arise from the fact that as the cooling ingot shrinks, the contracting metal tends to adhere to the sealing mechanism, causing "hanger cracks" which can destroy a considerable portion of the ingot's outer surface.

The system taught in prior U.S. Pat. No. 3,762,680 attempts to overcome the drawbacks of other hot top sealing systems through the use of a bar device, basically a piece of steel associated with the consumable hot top, the bar being constructed to facilitate formation of a seal between the ingot mold and the hot top. Such a design has inherent drawbacks, however, in that the bar and its associated assembly is positioned inside the ingot mold. Consequently, a significant portion of the hot top is located in the interior of the mold, reducing the total size and volume of the ingot that can be cast. In addition, it has been found that as the ingot cools and its outer skin shrinks in a downward direction in the mold, the release of the ingot's skin from the bar does not consistently occur, many times causing cracks to develop in the skin, damaging the surface of the ingot.

SUMMARY OF INVENTION

It is among the objects of the invention to prevent the "floating" of lightweight consumable hot tops during the pouring of molten metal into ingot molds.

Another object is to minimize the leakage of molten metal from ingot molds through the space between the lower portion of a consumable hot top and the adjacent top portion of the ingot mold.

Still another object is to provide a lightweight consumable hot top for an ingot mold which is of minimum vertical height, and which is consequently capable of forming a mold opening at the upper end of an ingot mold with a maximum transverse cross-section.

A further object of the invention is to provide a simple angular steel "anti-float bar" which not only seals the ingot mold to the hot top, but allows release of the cast ingot therefrom upon cooling so as to substantially eliminate and prevent cracks in the skin of the ingot as the latter solidifies.

These and other objects of the invention are accomplished by an improvement in a hot top for an ingot mold, which hot top is positioned prior to the pouring of an ingot with its lower end disposed on the upper end of the ingot mold, and which defines an interior opening for pouring molten metal into the mold, the density of the hot top being such that but for the improvement, it would tend to rise or "float" as the level of the molten metal rises in the mold during pouring. Such improvement resides in a metallic, two-sided angular anti-float bar secured to the bottom of the hot top which has one side of its angle disposed substantially horizontally between the bottom of the hot top and the top of the mold, and the other side of the angle directed substantially vertically downwardly immediately adjacent the interior peripheral edge of the mold, the bar being made of steel and having a sufficient mass and heat capacity to resist being melted upon contact with the rising surface of the molten metal, and capable of cooling and solidifying a layer thereof, which layer becomes thereby bonded to the bar. The vertical downwardly disposed portion of the bar includes a plurality of cutout slots that become filled with the rising molten metal, which upon cooling solidifies in the slots, the bottom boundry edge of the slots being of such dimensions as to easily tear loose during the shrinking of the solidified outer skin of the ingot, thereby allowing the outer skin of the ingot to contract downward into the ingot mold. The inside perimeter of the hot top is essentially co-extensive with the inside perimeter surface of the ingot mold.

BEST MODE FOR CARRYING OUT THE INVENTION

While the invention is applicable to many different types of hot tops, and to different variations and constructions thereof, for the purpose of illustration, the invention will be described with respect to the consumable type which are usually made from particulate refractory materials bonded with resins or soluble silicates, and which have a lining portion formed from an exothermic material which burns as the ingot solidifies.

The heat from the burning exothermic lining maintains that portion of the molten metal within the hot top itself in a molten state for a period of time sufficient to enable the molten metal to flow downward into the mold as the metal solidifies and shrinks.

Figure 1:
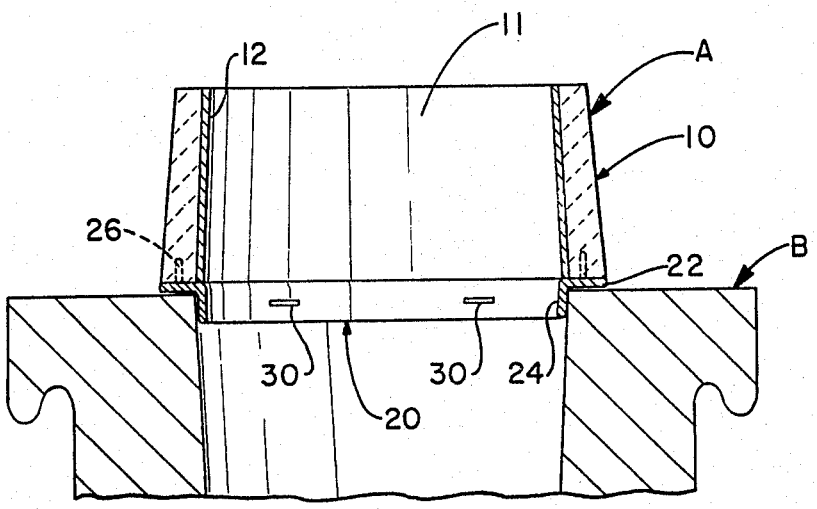
FIG. 1 is a side elevational, cross-sectional view of the ingot mold and hot top incorporating the improved sealing angle bar of the invention.

Referring more particularly to FIG. 1 of the invention, there is shown a hot top, A, positioned in the open end of a "big-end-up" type ingot mold, B, for making steel ingots. The ingot mold B can either be of the type used for top pouring, or that employed with bottom pouring, the mold having a rectangular transverse cross-sectional shape which tapers from a larger dimension at the top to a smaller dimension at the bottom. Such a shape facilitates stripping of a metal ingot from the mold B once the molten metal therein solidifies, and is a design well known in the art.

The hot top A, which is shown positioned in the open upper end of the mold B, generally comprises a main body portion in the form of a perimetric wall, broadly indicated by the numeral 10, which defines the central opening 11. The hot top may be filled either from the top or the bottom, depending on whether mold B is top poured or bottom poured. The wall 10 has an interior liner portion 12 formed of an exothermic material adapted to ignite and burn during the initial pouring of the molten metal, to help maintain the metal in the hot top in a molten state during the time required to avoid the "piping" phenomenon previously described. The perimetric wall 10 and lining 12 are molded and bonded together with a resin or a soluble silicate binder in the desired form, all as is well understood by those skilled in the art. The perimetric wall 10 may be formed, for example, from dolomite bonded together with a phenolic resin, and the exothermic lining 12 may be formed, for example, from any of the following components:

Fired Kyanite ($Al_2O_3$)-($SiO_2$)
Aluminum Dross (Al-$Al_2O_3$)
Ferro Silicon (FeSi)
Aluminum Powder (Al)
Manganese Dioxide ($MnO_2$—$MnO_3$)
Iron Oxide ($Fe_2O_3$)($Fe_3O_4$)
Flux [e.g. Sodium Fluoride ($NaF_2$), Potassium Fluoride ($KF_2$), Calcium Fluoride ($CaF_2$)]
Resin binder (e.g. a phenolic resin or a ureabased resin)
Sodium silicate binder Other suitable formulations and typical proportions of the various constituents are, for example, listed in the following patents: U.S. Pat. Nos. 2,490,327 to Soffel; 2,591,105 to Strauss et al; 3,006,046 to Shephard et al; 3,025,153 to Cross; 3,060,533 to Marburg; and 3,082,104 to Belz.

A primary distinction in the instant invention over U.S. Pat. No. 3,762,680 resides in the arrangement of the bottom part of the hot top being comprised of an angular steel bar, or angle iron as it is sometimes called, generally designated by numeral 20, one of whose sides, face flange 22, is positioned between the bottom of the hot top A and the top of the mold B. A vertically downwardly extending side, flange 24, lies adjacent the inside perimeter of the mold B, as is clearly shown in FIGS. 1 and 3.

In accordance with the invention, the bar 20 is essentially an angular flanged steel bar, with the flanges 22 and 24 being of approximately equal length, which is formed from hot roll steel or rod iron of a thickness, for example, of about 1/32 to 5/32 inches, a thickness of about 3/32 inches being preferred. The bar 20 serves as an antifloat means in the manner described below.

Figure 2:
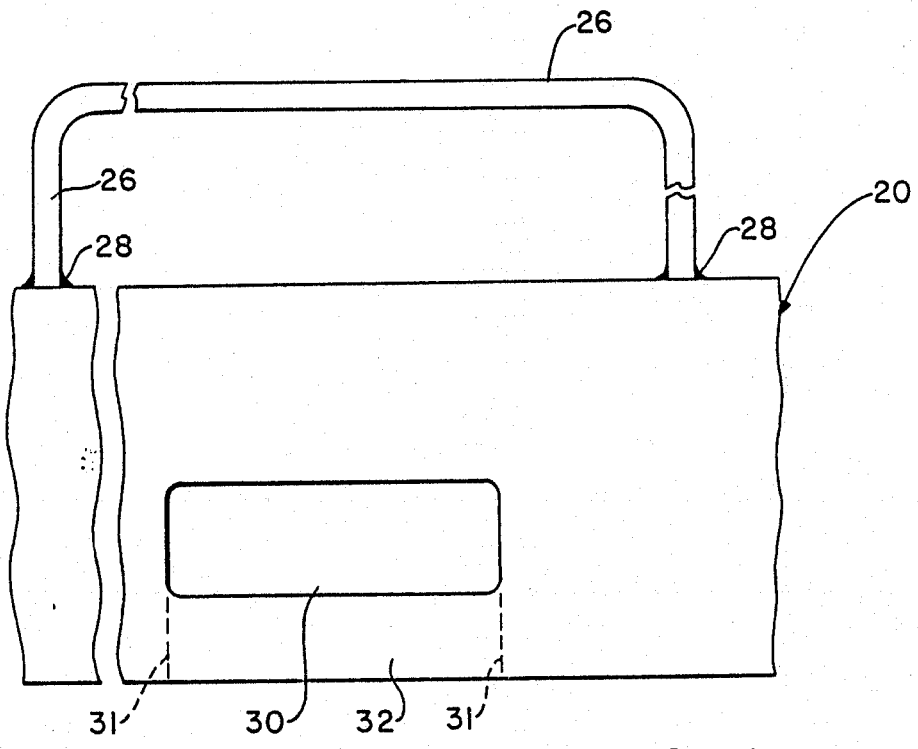
FIG. 2 is an enlarged broken away view illustrating the holes in the bar utilized for securing the hot top to the ingot mold during pouring, and which also indicates the tear-out portions of the bar which permit the solidifying ingot wall to move relative to the ingot mold and bar.

The anti-float bar 20 is secured to the perimetric wall 10 of the hot top by means of upwardly extending integral anchoring arms 26 which are welded to the top flange 22, as particularly indicated by welds 28 in FIG. 2. Typically, the arms 26 will extend three or four inches up into the wall 10 and form a firm anchoring of the bar 20 with respect thereto. Typically, one bar may extend along each side of the hot top, as it normally is somewhat rectangular, sometimes square in shape, conforming to the usual opening of the top of mold B.

The vertical sides of bars 20 also contain a plurality of holes 30. Such holes can be located up to about 12 to 15 inches apart, but usually are closer. Hole dimensions, as well as their locations, may also be varied within a relatively broad range. For example, with bars 20 having sides of about 25 to 27 inches long, there will normally be approximately one to two holes located on a side. Typical holes in such case will be in the neighborhood of $\frac{3}{4}$ of an inch long, $\frac{1}{8}$ inch high, and will be spaced about $\frac{1}{8}$ of an inch from tee bottom edge of the flange 24, with the flange frequently having an overall height of about $\frac{7}{8}$ of an inch. Alternatively, however, there might be as many as about five such holes, $\frac{3}{8}$ inch long.

Figure 3:
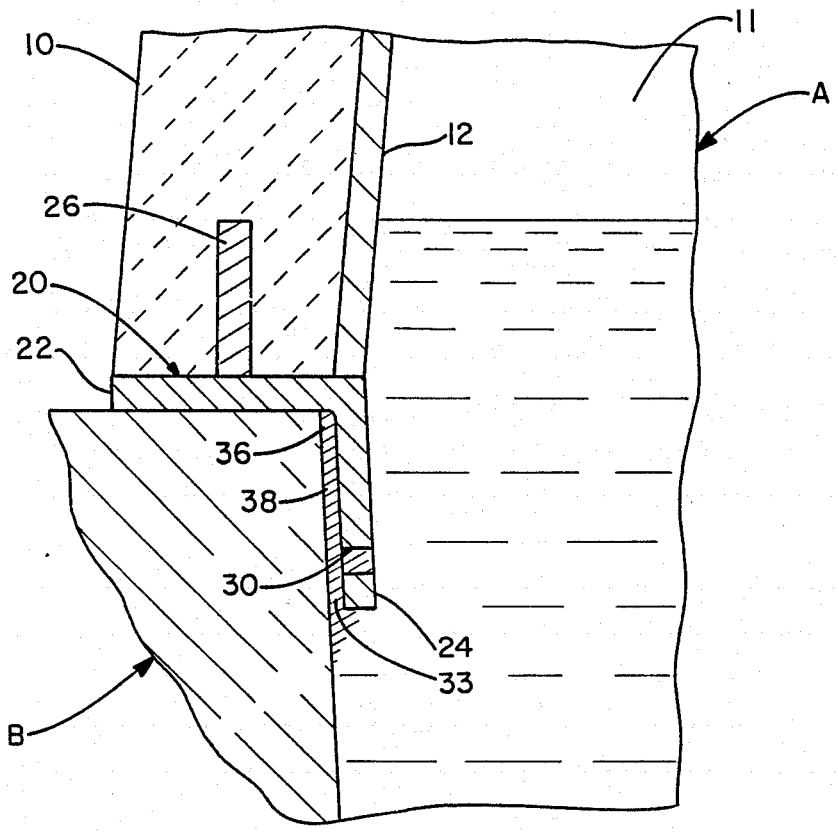
FIG. 3 is an enlarged cross-sectional view of a portion of the hot top and ingot mold, more particularly illustrating the relationship of the angle bar.

While spacing and hole dimensions may vary as described, it has been found that such a configuration works very effectively to prevent the floating of the hot top A. This result occurs as a consequence of the fact that the rising molten metal fills up the openings 30, as is best shown in FIG. 3 and then continues up the small spaced area 33 between the flange 24 and the inside perimeter face of the mold B until it finally solidifies, forming the seal indicated at the top edge at about numeral 36, and locking the hot top in place.

To explain further, as soon as the hot molten metal contacts the relatively cold, metal solidifying angle bar 20, it loses heat to the bar and thus cools and solidifies, at the same time forming a bond therewith. This occurs simultaneously with the forming of a solidified outer skin 38 immediately adjacent to the relatively cool walls of the mold. The solidified portions of the ingot adjacent to the anti-float bar 20, together with the solidified metal extending through the openings 30, and that between the bar 20 and the mold wall are contiguous with each other and therefore form a unified locking structure which prevents floatation of the hot top that would otherwise be caused by the buoyant force of the metal as it rises in the central opening of the hot top. FIG. 3 clearly illustrates the relationship between the bar 20 and the solidified metal of outer skin 38, as well as that extending through the opening 30.

It should be noted that there will occasionally be slight variations in the space between the bar 20, and the top inside perimeter of mold B. Consequently, the points at which solidification, and therefore, leak damming bonds occur along that space will vary somewhat from mold to mold. However, it will be found that the bar 20 will prevent the floating of the hot top A and will likewise seal the opening between the hot top A and the mold B so that there will be substantially no flashing or leaking of metal out between them.

Another important aspect of this invention made possible by the relatively narrow shear faces 31, is the tear-out section, best shown in FIG. 2 of the drawings where it is generally designated by numeral 32 situated immediately below the holes 30. Such section will in fact tear out along the shear faces 31 as the ingot cools. It is well known that during the early stages of solidification, the heat of the molten metal causes the area of the mold chamber to diminish, due to the inward expansion of the metal mold walls that results from the absorption of heat by the interior of the mold walls. This initial inward expansion of the mold chamber more than compensates for the initial shrinkage of the ingot as the latter cools, so that close contact of the mold with the ingot is maintained during the early stages of solidification.

The longer the period that the initial contact is maintaine, the thicker the initial skin of the cooling ingot will be, and the thicker it is, the greater its resistance to the pressure and heat emanating from the molten interior will be. This is important in view of the fact that, as soon as the mold walls become heated throughout, the entire mold becomes enlarged by expansion, and it then pulls away from the ingot, forming an air gap. At this point, the ingot must have a sufficiently thick skin to withstand the interior pressure, otherwise breaks in the skin will occur. While a thick strong skin is beneficial, therefore, if the solidified metal adhering to the wall surface of the ingot mold or attached to the anti-float bar is of sufficient strength to permanently hold the solidified skin and molten metal associated therewith, rather than letting it settle down in the mold, the weight of the molten metal will crack the solidified skin, resulting in a defect referred to as a "hanger crack". It is at this point, as the ingot separates from the mold chamber, and contracts down into the mold, that the separation of tear-out sections 32 occurs, an event which eliminates any possibility of hanger cracks occurring as a result of the bonding effect of the skin to.

Of course, once this solidification phase and the forming of the ingot has occurred, there is no longer any pressure tending to force the hot top A off the mold B, nor any likelihood of leakage between the hot top A and mold B; consequently, the functioning of bar 20 has been completed. It is apparent, therefore, that the tear-out of section 32 of bar 20 below the holes 30 for the purpose of eliminating hanger cracks is extremely important in obtaining the high quality ingots that are produced utilizing the unique combination of this invention.

From the foregoing, it will be understood that the bar 20 acts as a seal to prevent leakage of the molten metal between the hot top A and the mold B by acting as a heat sink, thereby weldably bonding itself to the metal, and thus forming a secure seal of the metal in the space between the hot top and the mold. The design of the bar also eliminates the likelihood of hanger cracks occurring in the ingot through the provision of tear-out sections which permit the ingot to free itself from the bar as cooling and solidification of the ingot occur. Further, it should be understood that with this construction, there is essentially a continuous opening extending from the inside of the mold through to the hot top, with only the thin edge of the flange 24 projecting into the mold cavity as an intrusion, thus allowing a maximum amount of metal to be poured into the mold, much more in fact than in the case of the reduced capacity achieved by the hot top 10 of U.S. Pat. No. 3,762,680.

Also, the inventio-n reduces labor costs in the ingot pouring phase of steel manufacturing by eliminating the need for lining the previously known permanent hot tops with refractory material; by obviating the necessity of repairing and maintaining permanent hot tops, and by making it unnecessary to remove and store the permanent hot tops with an overhead crane after pouring, thereby conserving crane time.

While the invention has been specifically described and illustrated with respect to the preferred embodiment, it is to be understood that the invention is not limited thereto or thereby, but that various modifications can be made within the spirit and the scope of the invention, such as modifying the number of holes, the length of the tear-out strips, the thickness of the bar material, the length of the flanges, etc., and still achieve the objects of the invention; consequently, the scope of the invention is limited only by the appended claims.

What is claimed is:

1. An ingot mold con:umable hot top having a bottom member fastened to the lower end of said hot top by means of anchoring arms integral with said member that extend into and fasten said hot top thereto, said member being adapted for positioning adjacent to the upper end of an ingot mold, wherein said member comprises an angle iron bar having a first flange that forms the baes of said hot top and that extends horizontally over at least part of the upper horizontal surface of the ingot mold, and a second flange directly and integrally connected with said first flange and extending downward therefrom an angle thereto substantially parallel to the inside perimetric surface of said mold, said second flange being exposed to direct contact with molten ingot metal rising in said mold, and said second flange having an exposed surface area capable of inducing solidification of the metal upon its contact with said second flange so as to form a solid skin bound to said second flange, and also capable of promoting the progressive formation of solid skin adjacent to said angle iron bar on the inside surface of said mold.

2. An ingot mold consumable hot top having a bottom member fastened to the lower end of said hot top by means of anchoring arms integral with said member that extend into and fasten said hot top thereto, said member being adapted for positioning adjacent to the upper end of an ingot mold, wherein said member comprises an angle iron bar having a first flange that forms the base of said hot top and that extends horizontally over at least part of the upper horizontal surface of the ingot mold,and a second flange directly and integrally connected with said first flange and extedding downward therefrom, at an angle thereto substantially parallel to the inside perimetric surrface of said mold, said second flange being exposed to direct contact with molten ingot metal rising in said mold, and said second flange having an exposed surface area capable of inducing solidification of the metal upon its Contact with said second flange so as to form a solid skin bound to said seocnd flange, and also capable of promoting the progressive formation of solid skin adjacent to said angle idon bar on the inside surface of said mold, wherein said second flange incorporates a plurality of holes around the perimeter thereof into which the rising molten ingot metal flows,and wherein only a relatively narrow section of metal is located between the holes and the bottom edge of said second flange which tears out as the ingot cools and shrinks.

3. A hot tol according to claim 2, wherein said hot top and its attached angle iron bar are rectangular in shape, and said bar has at least about two holes on each said of the second flange thereof, said holes being spaced no more than about fifteen inches apart.

* * * * *